US009729970B2

(12) United States Patent
Udesen et al.

(10) Patent No.: US 9,729,970 B2
(45) Date of Patent: Aug. 8, 2017

(54) ASSEMBLY AND A METHOD FOR DETERMINING A DISTANCE BETWEEN TWO SOUND GENERATING OBJECTS

(71) Applicant: GN Store Nord A/S, Ballerup (DK)

(72) Inventors: Jesper Udesen, Måløv (DK); Karl Fredrik Gran, Limhamn (SE)

(73) Assignee: GN Store Nord A/S (DK)

( * ) Notice: Subject to any disclaimer, the term of this patent is extended or adjusted under 35 U.S.C. 154(b) by 0 days.

(21) Appl. No.: 14/580,368

(22) Filed: Dec. 23, 2014

(65) Prior Publication Data

US 2015/0189440 A1 Jul. 2, 2015

(30) Foreign Application Priority Data

Dec. 30, 2013 (EP) ..... 13199759

(51) Int. Cl.

| | |
|---|---|
| ***H04R 25/00*** | (2006.01) |
| ***H04R 5/02*** | (2006.01) |
| ***H04S 1/00*** | (2006.01) |
| ***H04S 7/00*** | (2006.01) |
| *H04R 1/10* | (2006.01) |
| *H04R 5/033* | (2006.01) |

(52) U.S. Cl.

CPC ..... *H04R 5/02* (2013.01); *H04R 25/552* (2013.01); *H04S 1/00* (2013.01); *H04S 7/301* (2013.01); *H04R 1/1041* (2013.01); *H04R 5/033* (2013.01); *H04R 25/554* (2013.01); *H04R 2420/07* (2013.01); *H04S 2420/01* (2013.01)

(58) Field of Classification Search

CPC ..... H04R 1/1041; H04R 5/02; H04R 5/033; H04R 25/552; H04R 25/554; H04S 1/00; H04S 7/301; H04S 2420/01

See application file for complete search history.

(56) References Cited

U.S. PATENT DOCUMENTS

| | | | | |
|---|---|---|---|---|
| 6,181,800 | B1 | 1/2001 | Lambrecht | |
| 6,768,798 | B1 | 7/2004 | Dempsey | |
| 7,840,019 | B2 | 11/2010 | Slaney et al. | |
| 2008/0130408 | A1 * | 6/2008 | Pfaffinger | H04S 7/00 367/13 |
| 2013/0177166 | A1 | 7/2013 | Agevik et al. | |

FOREIGN PATENT DOCUMENTS

| | | |
|---|---|---|
| WO | 2006/059299 | 6/2006 |
| WO | 2006/131893 | 12/2006 |
| WO | 2008/006772 | 1/2008 |
| WO | 2010/086462 | 8/2010 |

OTHER PUBLICATIONS

European Search Report for European application No. 13199759 dated May 16, 2014.

* cited by examiner

*Primary Examiner* — Andrew L Sniezek

(74) *Attorney, Agent, or Firm* — Altera Law Group, LLc

(57) ABSTRACT

An assembly and a method for determining the distance between two sound providers, such as the ear pieces of a headset or two hearing aids. A signal is fed to the sound providers from a portable element, such as a mobile telephone, from a position to the side of the person, and from the travelling time of the signal, the distance is determined. Subsequently, audio signals taking the distance into account are fed to the sound generators.

8 Claims, 1 Drawing Sheet

ASSEMBLY AND A METHOD FOR DETERMINING A DISTANCE BETWEEN TWO SOUND GENERATING OBJECTS

BACKGROUND OF THE INVENTION

The present invention relates to a method of determining the distance between two sound generating objects to subsequently feed the objects with adapted audio signals. This may be used in order to e.g. provide a user with realistic 3D sound.

A usual manner of providing such sound is to adapt an audio signal on the basis of a Head Related Transfer Function selected for the particular user or distance.

The scientific literature on the subject of personalizing generic HRTF data is comprehensive. In general, the methods can be divided into 4 subcategories 1) Measure the HRTF's from a limited number of angles and apply this information to a generic HRTF database
2) Measure some physical properties like ear size and head size and adding this information to the generic HRTF database.
3) Take an image of the head and adding information from the image to the generic HRTF database.
4) Adjust or select the HRTF database based on user responses like e.g. listening tests.

Different manners of determining a HRTF may be seen in: U.S. Pat. Nos. 6,181,800, 6,768,798, 7,840,019 and US2013/177166.

BRIEF SUMMARY OF THE INVENTION

In a first aspect, the invention relates to a method of determining a distance between two sound generating objects, the method comprising the steps of:

positioning a signal provider at a position where the distance from the signal provider to the first and second objects are different, providing a first signal from one of a first of the objects and the signal provider to the other of the first of the objects and the signal provider, providing a second signal from one of a second of the objects and the signal provider to the other of the second of the objects and the signal provider, on the basis of the first and second signals, determining information relating to a distance between the first and second objects, and the signal provider accessing a first audio signal, forwarding to the objects a second audio signal, the objects outputting a sound which is based on the determined information.

In this respect, the distance may be a distance between any parts of the objects, which usually will comprise a sound generator, such as one or more loudspeakers, which may be based on any technology, such as moving coil, piezo electric elements or the like.

Often, each object will also comprise a housing wherein the sound generator(s) is positioned and which may be shaped to abut or engage a persons ear, such as to be placed over, on, in or at the ear.

In one embodiment, the objects are ear pieces of a headset, which usually also comprises a head band for biasing the ear pieces toward the head or parts of the head, such as at the ears, of the person.

In other embodiments, the objects may be hearing aids or ear pieces individually engageable with the ear, such as within the ear lobe, between the tragus and antitragus or around/above the ear.

The signal provider may be any type of element configured to output/receive the signals. The signal provider accesses an audio signal. This audio signal may be stored within the signal provider or may be stored remotely therefrom and is accessed via a network or data connection. The audio file may be retrieved in its entirety or streamed.

The signal provider preferably is portable, such as a mobile telephone, a media provider, a tablet, a portable computer or the like. In one embodiment, the signal provider is wirelessly connected to the objects and optionally further networks (GSM, WiFi, Bluetooth and the like). The signal provider may be powered by an internal battery.

The position is a position at which the distance, such as the Euclidian distance, from the signal provider to the objects is different. In this aspect, the distance difference preferably is larger than 2%, such as larger than 3%, such as larger than 4%, such as larger than 5%, such as larger than 6%, such as larger than 7%, such as larger than 8%, such as larger than 9%, such as larger than 10%, such as larger than 15%.

In one embodiment, the signal provider is positioned at a position at least substantially along a line or plane intersecting the first and second objects, such as centres of the objects. In one situation, an angle exists between a line intersecting the objects, such as centres thereof, and a line from the signal provider to an object closest to the signal provider, where this angle is 10° or less, such as 5° or less. Preferably this angle is zero.

In one situation, the user may hold the signal provider to his side and in a straight arm while look straight ahead.

The first and second signals may be any type of signal, such as sound, acoustic signals, electromagnetic signals, radio waves, optical signals or the like. Presently, sound is preferred, as the velocity thereof is rather low, which makes the distance more easily determinable.

The first and second signals may be identical, of the same type or of different types. The signals may have any frequency content and/or intensity. In one embodiment, one or both of the signals comprise sharp increases or decreases over time so that a timing may be determined from the detection thereof. In another situation, one or both of the signals have a frequency content and/or intensity which vary/ies over time.

In one embodiment, the determination is performed as a cross correlation of one of the first or second signal with the signal itself. In this manner, a delay from transmission to detection (i.e. the travelling time plus e.g. hardware delays) for the signal may be determined. Knowing also the delay for the other signal, as well as the type of signal (sound travels at one speed, electromagnetic waves at another), the distance may be determined. The hardware delays may be known or may be the same for the two signals and may thus cancel out.

In preferred embodiment, one or both of the signals are MLS signals, such as pseudo-random MLS signals.

MLS signals may be generated using primitive polynomials or shift registers. A MLS signal preferably is a randomly distributed sequence of same amplitude, same positive and negative impulses, so that the sequence is symmetrical around 0. Preferably at least 10,000 pulses exist per sequence and may have $2^n-1$ pulses, where n may be a number of shift registers, if shift registers are used. 16 shift registers would give 65,535 samples.

MLS signals may be auto correlated to identify the distance information desired.

A first auto correlation of a MLS signal (with itself) may provide a Dirac signal which will be distorted by filtering etc. of the surroundings. Nevertheless, the peak of the Dirac function may be determined and the transmission delay determined. However, if both signals are MLS signals, they may, subsequent to the auto correlation of the individual signals, be auto correlated with each other, whereby the distance may be determined in a simple manner.

In general, it may be desired to filter the signal received in order to remove higher frequencies, such as frequencies above 5 kHz, such as frequencies above 3 kHz, such as frequencies above 2 kHz. Such higher frequencies may deteriorate the above correlations as they may stem from influences of the surroundings, such as the head shadowing in the transmission of one of the signals.

It is clear that the same signal or the same type of signal may be used for the first and second signals, but different signals or types of signals may be used. The determination of the distance may be based on different manners of detecting the signals and e.g. different manners of detecting a distance of travel of the first and second signals, if the determination is made on such two distances.

Naturally, the first and second objects may comprise suitable elements for outputting the signals. If the signals are sound, sound generators may be used. These may be the same sound generators as may be used for providing sound to the ears of the person, or other sound generators. If the signals are RF signals, WiFi signals or the like, suitable antennas may be provided. If the signals are optical signals, radiation emitters may be provided.

The determination of the information relating to the distance will depend on the nature of the signals. This determination may be performed on the basis of timing differences of predetermined or recognisable parts, such as sharp peaks, of the signals. Alternatively, the above auto correlation or cross correlation may be used.

The information may be a quantification of the distance itself. Alternatively, another quantity or measure may be determined which correlates with the distance. A choice may be made on the basis of the signals, where different choices may depend on different distances, so that one choice is made, if the distance (determined or indicated by the signals or the result of the determination) is within a first interval, a second choice is made, if the distance is within another, different, interval.

The signal provider accesses a first audio signal, forwards to the objects a second audio signal, the objects outputting a sound which is based on the determined information.

In this respect, an audio signal may be any type of signal, such as an analogue signal or a digital signal. The signal may be a file or a streamed signal, and any format, such as MPEG, FLAK, AVI, amplitude/frequency modulated or the like may be used.

In one situation, the signal provider generates the second audio signal by altering the first audio signal on the basis of the determined information. This second audio signal may then be fed to the objects which output a sound corresponding to the second audio signal, as usual loudspeakers or headsets would.

Naturally, additional adaptation of the audio signals may be performed, such as filtering and amplification as is usual in the art. Filtering may be performed to alter the sound to the preference of the user or to the type of sound generated (pop, classical and the like). Also, such adaptation may be performed to counteract non-liniarities in the sound generators, for example.

In another situation, a processor receives the second audio signal and generates a third audio signal based on the determined information, which third audio signal is fed to the objects in order to generate sound.

Thus, the above adaptation to the distance information may be performed in the processor, which may be a part of one of the objects or an assembly also comprising the objects. The additional adaptations may also be performed by this processor or the signal provider.

In one situation, the distance information is a quantification of the distance on the basis of which parameters are selected which describe the adaptation of one audio signal into another audio signal. These parameters may be stored in a library—internally or externally—available to the signal provider or the processor.

In one embodiment, the first and second signals are transmitted from the signal provider to the first and second objects, respectively, and the objects detect the signals. In this embodiment, the objects may additionally receive a common clocking signal in order to detect the signals with the same clock. Alternatively, the objects may simply detect and immediately output a corresponding signal, such as to the signal provider or the above processor.

In this situation, the sound generating objects may be hearing aids configured to be worn at/on/in the ears of a person. Hearing aids comprise microphones for receiving sound from the surroundings thereof. These microphones may suitably be used also for detecting the signals, when these signals are sound. Preferably, the hearing aids are binaural hearing aids configured to communicate with each other. This communication may be used also for the detection, where one hearing aid may detect the corresponding signal and output a corresponding signal to the other hearing aid for the determination of the distance information.

In another situation, the sound generating objects are ear pieces of a headset. These ear pieces then comprise elements, such as microphones or antennas, for receiving the signals. Noise reducing headsets are known which already have microphones, and these microphones may be used for receiving the signals, when these are sound signals.

In one embodiment, the first and second signals are transmitted from the first and second objects, respectively, to the signal provider wherein the signal provider detects the signals. This facilitates detection in the situations where the signals are output simultaneously and are to be detected simultaneously, such as when a phase difference is to be determined.

In one situation, the first and second objects are ear pieces of a headset. Ear pieces comprise sound generators for providing sound to the ears of a person. These sound generators may be used to generate the signals, if the sound is allowed to escape from the ear pieces while worn by the user. Some ear pieces, however, are so-called "closed", whereby sound is desired to not exit the ear pieces. Thus, the ear pieces may comprise first sound generators for providing sound to a person's ears and wherein the signals are output by additional signal providers configured to output the signals toward the surroundings of the ear pieces.

A second aspect of the invention relates to an assembly comprising a signal provider, a processor and two sound generating objects, wherein:

the signal provider is configured to obtain a first audio signal and transmit a second audio signal to the first and second objects, the signal provider is configured to output an additional signal to the first and second objects, the first and second objects are configured to receive the second audio signal and feed a third audio signal to sound generators thereof, the first and second objects are each configured to receive the additional signal and output a corresponding signal, and the processor is configured to receive the corresponding signals and derive information relating to a distance between the first and second objects, the processor being configured to:

convert the first audio signal into the second audio signal on the basis of the derived information and/or convert the second audio signal into an third audio signal and feed the third audio signal to the sound generators.

In this context, an assembly is a group of elements/objects which may be attached to each other or not and which may communicate with each other or not. The communication may be wireless or wired, and any protocol, wavelength and type of communication may be used. Then, the objects, signals provider and the like, as the skilled person will know, has the required data communication elements, such as receivers, transmitters, network interfaces, antennas, signal generators, signal receivers/detectors, loudspeakers, microphones and the like, for the type of data and communication desired.

Preferably, the objects are configured to be positioned at, on or in the ears of a person. An object may comprise elements, such as an outer surface, ear hooks or the like, for attaching to or on the ear of a person. Additionally or optionally, the objects may form part of an assembly comprising further elements, such as a headband, configured to bias the ear pieces toward the ears of a person and maintain this position either by the biasing or by supporting itself on the head of the person The signal provider, as is mentioned above, preferably is portable and in wireless communication with the objects and optionally other networks or data sources.

The signal provider is configured to obtain the first audio signal and transmit the second audio signal. The signal provider may comprise an internal storage from which the first audio signal may be accessed. Alternatively or additionally, the signal provider may comprise elements, such as antennas, network elements or the like, from which a signal may be received, from which the first audio signal may be derived. The signal may be received from a data source via a network (GSM, WiFi, Bluetooth for example), and the signal or audio signal may have any form, such as analogue or digital.

The signal provider preferably outputs the second audio signal in a wireless manner to the objects, but wires are also widely used for e.g. headsets.

The signal provider is configured to output an additional signal to the first and second objects. This signal may be fed in the same manner or on the same wires, for example, to the objects, so that additional communication elements (antennas, wires, detectors or the like) are not required. However, additional communication elements may be provided if desired.

The additional signal may be output while providing the second audio signal or not. The second signal may be discernible from the audio signal in any manner, such as in a frequency thereof, a level thereof, a type thereof (non-audio signal), or the like.

The first and second objects are configured to receive the second audio signal and feed a third audio signal to sound generators thereof. The sound generators will typically convert the third audio signal into corresponding sound, where "corresponding" will mean that the sound generators may mimic the frequency contents and relative levels of the frequencies of the audio signals, such as to the best of their abilities.

The first and second objects are each configured to receive the additional signal and output a corresponding signal. This corresponding signal may be the received signal or relevant information relating thereto. This relevance will depend on the type of the additional signal and the type of determination to be performed. If the determination is to be performed on the basis of a time of receipt of a particular part of the additional signal, this point in time will be relevant. If the additional signals are MLS signals, white noise signals or the like, which may be auto or cross correlated to determine the distance or time/distance of travel.

The processor is configured to receive the corresponding signals and derive the information relating to a distance. The transfer of the corresponding signals to the processor may take place in any desired manner, wireless or wired, for example. Again, the required communication elements will be provided for this communication to take place.

A processor may be a single chip, such as an ASIC, a software controlled processor, an FPGA, a RISC processor or the like, or it may be a collection of such elements.

The conversion of one audio signal to another audio signal may be to adapt the audio signal to the distance between the objects. This is desired when providing 3D sound to the user, which preferably is adapted to the distance between the ears of the person in order to present realistic sound to the user.

This adaptation may a conversion based on one or more parameters, such as a filtering, which parameters may be calculated, determined or selected on the basis of the distance information.

Naturally, further adaptations of the audio signal may be desired. In some instances, adaptation, such as filtering, may be performed to adapt the sound to the preferences of the user.

Also, the conversion of the second audio signal to the third audio signal may comprise a conversion from a digital signal to an analogue signal and optionally also an amplification of the analogue signal.

Naturally, the first and second audio signals may be identical if desired, as may the second and third audio signals.

In one embodiment, the first and second objects are first and second hearing aids, respectively, configured to be worn at/on/in the ears of a person. In that situation, the hearing aids have elements, such as an ear hook or a suitably designed outer surface, for engaging with the ears of the person. The hearing aids usually have a microphone for detecting sound from the surroundings and a speaker, often called a receiver, for providing sound to the person's ear canal. In a preferred embodiment, the hearing aids are binaural hearing aids and thus are configured to communicate—usually wirelessly—with each other. In a preferred embodiment, the additional signal is a sound which may be detected by the microphones already present in hearing aids. Optionally, the signal may be of another type, where the hearing aids then comprise elements for detecting that type of signal.

The communication between the hearing aids may be used for sharing timing information, such as a clocking signal, if timing of the additional signal is of importance.

The processor may be provided in or at the first hearing aid, where the second hearing aid is then configured to transmit the corresponding signal to the first hearing aid. This may be handled by the communication already provided for in binaural hearing aids.

In another embodiment, first and second objects are comprised in an assembly also comprising the processor and elements configured to transport the corresponding signals from the first and second objects to the processor. An assembly of this type may be a headset where the processor is provided in e.g. an ear piece or a headband if provided.

Alternatively, the processor may be provided in the signal provider. This processor may be a part of an already provided processor handling communication, user interface and the like.

As mentioned above, the determination may be a selection of parameters or the like from a library of such data present in the processor or a storage available thereto or remotely and available via e.g. a network.

In one embodiment, the additional signal may be an instruction for the objects to output the corresponding signals to the signal provider. The instruction may simply be an instruction to output the corresponding signals. In another situation, the instruction comprises information identifying one of a number of signal types or different signals from which the object may choose. Thus, the instruction may identify the signal to be output.

In this situation, the signal provider may control the timing and/or parameters of the signals and thus adapt these to a certain determination. The signal provider may choose one type of signals if audio signals are provided to the objects or if the surroundings have a lot of noise, and another type of signal if not.

In a third aspect, the invention relates to an assembly comprising a signal generator, a processor and two sound generating objects, wherein:

- the signal provider is configured to obtain a first audio signal and transmit a second audio signal to the first and second objects,
- the first object is configured to output a first signal to the signal provider,
- the second object is configured to output a second signal to the signal provider,
- the first and second objects are configured to receive the second audio signal and feed a third audio signal to signal generators thereof,
- the signal provider is configured to receive the first and second signals and output a corresponding signal, and
- the processor is configured to receive the corresponding signals and derive information relating to a distance between the first and second objects, the processor being configured to:
  - convert the first audio signal into the second audio signal on the basis of the derived information and/or
  - convert the second audio signal into a third audio signal and feed the third audio signal to the sound generators.

This aspect is rather similar to the second aspect, and a number of the comments made to the second aspect are equally relevant here.

When an object, for example, is configured to receive a signal, the object may comprise any type of element, such as a detector/sensor/antenna/microphone, capable of receiving/detecting/sensing the signal in question. Similarly, when an object, for example, is configured to output a signal, the object may comprise any type of element, such as an emitter/antenna/transmitter/loudspeaker, capable of outputting the signal in question. Different types of elements are required for different types of signals.

In this aspect, the objects are configured to output a first and a second signal, respectively, to the signal provider. The objects thus may initiate the process. The signal provider is configured to receive the signals and output a corresponding signal.

Again, the signal provider may access and forward audio information for the objects to convert into sound.

The signal provider outputs a signal corresponding to the first/second signals. This signal is fed to the processor. In the situation were the processor is positioned in the signal provider, the first and second signals may be fed directly to the processor which then acts thereon and derives the information distance.

If the processor is not provided in the signal provider, the corresponding signal may be any type of signal from which the distance information may be derived by the processor.

The determination of the distance may be as those described further above. As mentioned above, the processor may be hardwired, software controlled or a combination thereof.

The subsequent conversion of one audio signal to another audio signal may be as described above.

In one embodiment, the first and second objects are ear pieces of a pair of headphones, as is also described above.

In the situation where the ear pieces each are closed earpieces, each ear piece may further comprise a signal generator configured, such as positioned, to output the first and second signals, respectively, to surroundings of the ear pieces. Alternatively, the ear pierces may be open so that sound may escape from the sound generator to the surroundings.

In general, activation of the distance determination may be a user activating an activatable element on the objects or the signal provider. The user may initiate an application on a mobile telephone or depress a push button on a headset. Alternatively, the headset or hearing aid may sense that it is brought into activation and may then initiate the distance determination and the subsequent adaptation of the audio.

BRIEF DESCRIPTION OF THE DRAWINGS

In the following, preferred embodiments of the invention will be described with reference to the drawing, wherein.

DETAILED DESCRIPTION OF THE INVENTION

Figure 1:
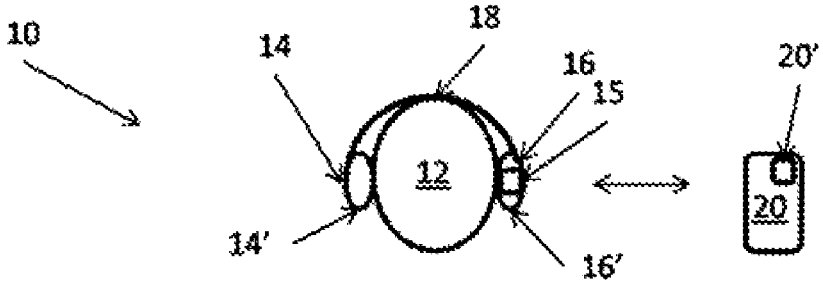
- FIG. 1 illustrates a first embodiment with a mobile telephone and a headset and
- FIG. 2 illustrates a second embodiment with a mobile telephone and two hearing aids.

In FIG. 1, a first embodiment, 10, is seen wherein a headset 18 is worn on the head 12 of a person. The headset has two ear pieces 14/16 which are positioned and configured to provide sound to the person's ears. These ear pieces may be open or closed, which means that sound from the outside may enter to the persons ears or not. Closed earpieces may e.g. be used for noise reduction for use on airplanes or the like.

Present is also a mobile telephone 20, which may instead be a media player or the like. This telephone/media player 20 is configured to communicate with the headset 18 and particularly with the ear pieces 14/16 so as to provide an audio signal thereto.

The overall object is to provide, to the ears of the person a signal which is adapted to the distance between the persons ears. This is particularly interesting when emulating 3D sound to the person.

The telephone is in communication with the headset 18 and may instruct the ear pieces 14/16 to output a sound or other signal which is detectable by the telephone 20. The telephone 20 is positioned to the side of the persons head so that the signal between the ear pieces and the telephone 20 has different travelling distances. From the signals detected by the telephone 20, the distance between the person's ears—or rather between the ear pieces— may be determined. The telephone 20 may use this distance information to adapt audio information, such as in a processor 20' thereof, to this distance and subsequently output the adapted audio signal to the headset 18 for providing to the person.

During operation, the user may hold the telephone 20 in his/her straight arm to the side of the person (perpendicular to the line of sight of the person) to obtain the maximum distance difference between the telephone 20 and the ears, respectively.

If the ear pieces are closed ear pieces so that sound output toward the person's ears is no sufficiently discernible from a distance, the ear pieces may comprise additional signal generators 32 and 34 positioned and configured to output a signal toward the surroundings.

The signals output may be sharp pulses, whereby the telephone 20 may determine the distance from a time difference there between.

Another manner will be to output a signal with a predetermined level and determine the distance from a level detected by the telephone 20.

Alternatively, the ear pieces 14/16 may output MLS signals from which the distance may be determined.

This determination may be based on firstly auto correlating the individual signal with itself to obtain a Dirac-shaped pulse from which a peak may be determined. A subsequent auto correlation of the two Dirac-shaped pulses will give a measure of the distance between the ear pieces 14/16.

The outputting of the signals from the ear pieces 14/16 may be controlled by a controller 15 of the headset 18.

It is noted that the signals are not required output by the ear pieces 14/16 at the same time. When the telephone 20 is able to control the outputting of the signal from the individual ear pieces, the individual signals may be received/detected and subsequently analysed together.

However, in some situations, it is desired that the ear pieces output the signals in a timed manner, whereby the ear pieces may be synchronized. The ear pieces may communicate with each other or a central unit, such as the controller 15. The controller or unit may have a clocking unit common to the ear pieces, for example.

Naturally, the processor or central unit may be controlled, such as timed, by the telephone, such as via the instruction received therefrom, so that the outputting of the signals are ultimately timed by the telephone.

The actual signals to output may be pre-programmed in the ear pieces 14/16. A library of signals may be pre-programmed therein, where the instruction from the telephone may identify the signals to be used. In another situation, the instruction from the telephone may itself comprise the signal to be output.

The reverse situation may also be used where the telephone 20 outputs a signal which is detected by the ear pieces 14/16, which then comprise signal receivers illustrated at 14'/16'. These receivers output signals from which the distance may be determined either by the processor 15, if provided, with which the receivers may communicate via wires or wirelessly, or information relating to the detected signal may be fed by the ear pieces (or processor 15) to the telephone 20 for analysis. The signals output by the receivers may be an immediate outputting (mirroring) of the signals detected, or other information may be derived which takes up less bandwidth or time to transmit.

When the determination is performed in the processor 15, the future adaptation of audio signals may be performed in the processor 15, or the result of the determination may be fed to the telephone 20 for future use therein.

Figure 2:
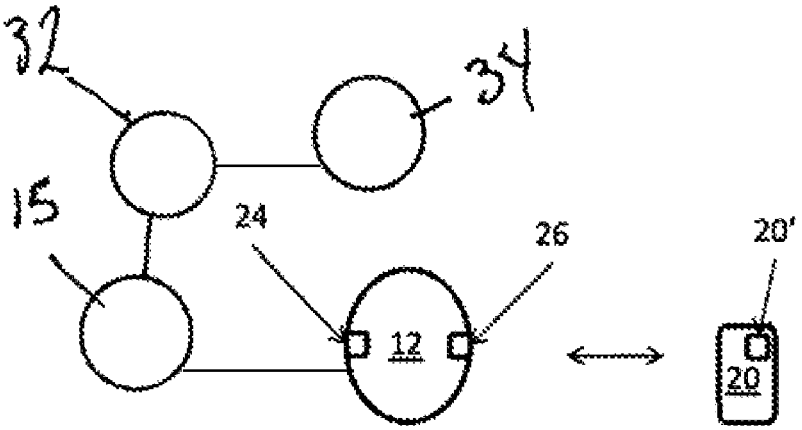

FIG. 2 illustrates a slightly different embodiment, where the user uses two hearing aids 14' and 16' positioned in, at or on the ears of the person. The same operation as that of FIG. 1 may be used. In this situation, however, it is preferred that the signal is output by the telephone 20, so that the hearing aids may use the built-in microphones for receiving the sound. The hearing aids 24/26 may be binaural hearing aids which are configured to communicate wirelessly. As mentioned above, the hearing aids 14'/16' may output the information relating to the signals received to the telephone 20 or may process this, such as in a processor (not illustrated) provided in of one or both hearing aid(s).

Having determined the distance, a variety of manners are known in which an audio signal may be adapted to this distance. The most widely used method is the use of Head Related Transfer Functions (HRTFs). Usually, the distance between the ears will be determined and a suitable HRTF will be selected, where after the audio signal will be adapted in accordance with the HRTF selected. Usually, a small number of HRTFs are provided, such as 3, 4, 5, 6, 7, 8, 9, 10 or 11 HRTFs may be provided and between which a suitable HRTF selected.

The adaptation of the audio signal on the basis of the selected HRTF is known to the skilled person.

Naturally, the communication between the telephone 20 and the ear pieces 14/16 or the hearing aids 24/26, as well as between the ear pieces 14/16 and hearing aids 24/26 if desired, may be wired or wireless. The communication between the ear pieces 14/16 or hearing aids 24/26 may be different from that between the earpieces or hearing aids and the telephone. Wireless communication may be based on any desired protocol and wavelength, and different wavelengths/protocols may be used if desired.

One of the telephone or headset or hearing aids may have an operable element, such as a push button, a touch pad, a touch screen, a microphone, a camera or the like, which may be used for initiating the above process. This element may then cause the signal(s) to be output and detected and the distance information derived. If this element is provided on the telephone and the ear pieces, for example, are to output the signal, the telephone may instruct the ear pieces to do so. If the element is provided on the telephone which is to output the signal, the telephone may warn the headset or hearing aids that signals will be output, or the headset/hearing aids (also referred to as "Objects" elsewhere wherein) may be permanently ready for receiving the signals.

The process may be initiated automatically, such as when the hearing aids or headset is/are turned on or the headset is mounted on the head (the head band is twisted or expanded, the temperature rises or the like), so that the compensation may be performed in relation to the actual user—such as if different users may use the headset or hearing aid.

The signals output by the ear pieces/hearing aids/telephone may be the same to/from each ear piece/hearing aid, or the signals may be different.

Preferably, the signals are audio signals, such as signals with a frequency below 2 kHz, but this is not a requirement.

Naturally, the distance signal or audio parameters derived need not be utilized by the telephone 20. This information may be stored in the headset 18 or hearing aids and may be transmitted to any signal provider providing an audio signal to the headset 18.

Alternatively, the headset 18 or hearing aids may be configured to, such as in the processor 15, receive a standard audio signal and transform this audio signal into that which is desired provided to the hearing aids 24/26 or ear pieces 14/16, whereby the headset 18 and hearing aids may receive audio signals from any types of sources.

A database of the compensation information or parameters for use therewith may be provided in the telephone 20 (or hearing aids or headset), so that the telephone may itself convert or adapt the audio signals. Alternatively, the telephone 20 may be in communication with an element, such as via GSM or the internet, with a database of such parameters. Naturally, such communication may be independent of and use a different protocol and wavelength that that to the headset/hearing aids.

The invention claimed is:

1. A method of determining a distance between two sound generating objects, the method comprising the steps of:

positioning a signal provider at a position where the distance from the signal provider to the first and second sound generating objects are different, generating a first signal from the first sound generating object to the signal provider, generating a second signal from the second sound generating object to the signal provider, on the basis of the first and second signals, determining information relating to a distance between the first and second sound generating objects, and the signal provider accessing a first audio signal and generating a second audio signal by altering the first audio signal on the basis of the determined information and forwarding the second audio signal to the sound generating objects outputting a sound which is based on the determined information wherein the first and second signals are provided from the first and second sound generating objects, respectively, to the signal provider wherein the signal provider detects the signals.

2. A method according to claim 1, wherein the first and second objects are ear pieces of a headset.

3. A method according to claim 2, wherein the ear pieces comprise first sound generators for providing sound to a persons' ears and wherein the signals are output by additional signal providers configured to output the signals toward the surroundings of the ear pieces.

4. A method of determining a distance between two sound generating objects, said objects being capable of sound generation and sound detection, the method comprising the steps of:

positioning a signal provider at a position where the distance from the signal provider to the first and second sound generating objects are different, generating a first signal from the first sound generating object to the signal provider, generating a second signal from the second sound generating object to the signal provider, on the basis of the first and second signals, determining information relating to a distance between the first and second sound generating objects, and the signal provider accessing a first audio signal and generating a second audio signal by altering the first audio signal on the basis of the determined information and forwarding the second audio signal to the sound generating objects outputting a sound which is based on the determined information wherein the first and second signals are provided from the first and second sound generating objects, respectively, to the signal provider wherein the signal provider detects the signals; and wherein the first and second signals are provided from the signal provider to the first and second sound generating objects, respectively, and wherein the objects also detect the signals.

5. A method according to claim 4, wherein the sound generating objects are hearing aids configured to be worn on the ears of a person.

6. A method according to claim 4, wherein the sound generating objects are ear pieces of a headset.

7. An assembly comprising:

a signal provider;

a processor; and first and second sound generating objects connected to the processor, wherein:

the signal provider is configured to obtain a first audio signal and transmit a second audio signal to the first and second sound generating objects, the signal provider is configured to output an additional signal to the first and second sound generating objects, the first and second sound generating objects are configured to receive the second audio signal and feed a third audio signal to sound generators of the sound generating objects thereof, said third audio signal mimicking the contents of said second audio signal;

the first and second sound generating objects are each configured to receive the additional signal and then output a corresponding signal, and the processor is configured to receive the corresponding signal and derive information relating to a distance between the first and second sound generating objects, the signal provider being configured to convert the first audio signal into the second audio signal on the basis of the derived information;

wherein the first and second sound generating objects are first and second hearing aids, respectively, configured to be worn on the ears of a person; and wherein the processor is provided in or at the first hearing aid and the second hearing aid is configured to transmit the corresponding signal to the first hearing aid.

8. An assembly comprising:

a signal provider;

a processor; and first and second sound generating objects connected to the processor, wherein:

the signal provider is configured to obtain a first audio signal and transmit a second audio signal to the first and second sound generating objects, the signal provider is configured to output an additional signal to the first and second sound generating objects, the first and second sound generating objects are configured to receive the second audio signal and convert said second audio signal into a third audio signal to sound generators of the sound generating objects thereof, said third audio signal mimicking the contents of said second audio signal;

the first and second sound generating objects are each configured to receive the additional signal and then output a corresponding signal, and the processor is configured to receive the corresponding signal and derive information relating to a distance between the first and second sound generating objects, the signal provider being configured to convert the first audio signal into the second audio signal on the basis of the derived information; and wherein the first and second sound generating objects are comprised in an assembly also comprising the processor and elements configured to transport the corresponding signals from the first and second sound generating objects to the processor.

* * * * *